US008235091B2

(12) United States Patent
Ozaki et al.

(10) Patent No.: US 8,235,091 B2
(45) Date of Patent: Aug. 7, 2012

(54) AMORPHOUS RIBBON TAKE-UP ROLL SWITCHING METHOD AND SWITCHING SYSTEM

(75) Inventors: Shigekatsu Ozaki, Tokyo (JP); Takeshi Imai, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 201 days.

(21) Appl. No.: 12/311,562

(22) PCT Filed: May 10, 2007

(86) PCT No.: PCT/JP2007/070032

§ 371 (c)(1),
(2), (4) Date: Apr. 1, 2009

(87) PCT Pub. No.: WO2008/044788

PCT Pub. Date: Apr. 17, 2008

(65) Prior Publication Data

US 2009/0324315 A1 Dec. 31, 2009

(30) Foreign Application Priority Data

Oct. 10, 2006 (JP) ..... 2006-276619
Oct. 10, 2006 (JP) ..... 2006-276620

(51) Int. Cl.
*B22D 11/06* (2006.01)
*B65H 19/22* (2006.01)

(52) U.S. Cl. ..... 164/423; 164/463; 242/533.3

(58) Field of Classification Search ..... 164/423, 164/462, 463; 242/533.3, 533.4, 533.5
See application file for complete search history.

(56) References Cited

U.S. PATENT DOCUMENTS 5,190,232 A * 3/1993 Brandon et al. ..... 242/533.4

FOREIGN PATENT DOCUMENTS

| | | | |
|---|---|---|---|
| EP | 316949 | * | 5/1989 |
| JP | 58-23544 | | 2/1983 |
| JP | 63-174763 | | 7/1988 |
| JP | 01-187156 | | 7/1989 |
| JP | 05-139583 | | 6/1993 |
| JP | 08-024943 | | 1/1996 |
| JP | 08-318352 | | 12/1996 |
| JP | 11-028552 | | 2/1999 |
| JP | 2001-269750 | | 10/2001 |
| JP | 2004-050218 | | 2/2004 |
| JP | 2007-275926 | | 10/2007 |

OTHER PUBLICATIONS

Japanese Office Action dated Sep. 28, 2010 issued in related Japanese Application No. 2007-105107, with translation. Japanese Office Action dated Sep. 28, 2010 issued in related Japanese Application No. 2006-276619, with translation.
Japanese Office Action dated Sep. 28, 2010 issued in related Japanese Application No. 2006-276620, with translation.
International Search Report dated Jan. 15, 2008 issued in corresponding PCT Application No. PCT/JP2007/070032.

* cited by examiner

*Primary Examiner* — Kuang Lin
(74) *Attorney, Agent, or Firm* — Kenyon & Kenyon LLP

(57) ABSTRACT

The present invention provides an amorphous ribbon take-up roll switching and method which use a take-up device provided with a plurality of take-up rolls magnetized on their surfaces so as to take up an amorphous alloy ribbon during which it is possible to simply and inexpensively switch take-up rolls stably without ribbon breaking, uneven take-up, or other trouble regardless of the amount of take-up, that is, a method of taking up amorphous ribbon having a magnetic property cast using a cooling roll by using two or more take-up rolls, which amorphous ribbon switching method characterized by, when switching the take-up rolls, bringing the amorphous ribbon into contact with the next take-up roll and cutting the amorphous ribbon being taken up in the state with the next take-up roll brought into proximity with the cooling roll or separating the next take-up roll and the cooling roll and cutting the amorphous ribbon between the take-up roll and the next take-up roll.

2 Claims, 13 Drawing Sheets

AMORPHOUS RIBBON TAKE-UP ROLL SWITCHING METHOD AND SWITCHING SYSTEM

TECHNICAL FIELD

The present invention relates to a method of taking up on-line an amorphous ribbon cast using a cooling roll by using a take-up device comprised of a plurality of two or more take-up rolls.

BACKGROUND ART

The methods for rapid cooling and solidification of amorphous ribbon include the single roll method, the twin roll method, etc. The most general method is the single roll method. This single roll method ejects molten metal to the surface of a high speed rotating cooling roll and rapidly cools and solidifies it on this cooling roll so as to continuously obtain an amorphous ribbon. When producing amorphous ribbon on an industrial scale, usually it is necessary to secure this rapidly cooled and solidified amorphous ribbon by winding it up. Up to now, various methods and systems have been proposed for the take-up method for taking up amorphous ribbon on line right after casting, but in general the method and system of using a take-up roll and taking up the ribbon by rotation of the take-up roll have been employed. For example, Japanese Patent Publication (A) No. 8-318352 proposes a take-up method taking up an amorphous ribbon having a magnetic property using a take-up roll magnetized on its surface and making a range of surface speed of the take-up roll at the time of catching the amorphous ribbon tip 90% to less than 100% of the surface speed of the cooling roll. However, using just a single take-up roll to take up the ribbon means there is a limit to the take-up weight due to the equipment and, further, makes it necessary to balance the casting speed, take-up speed, tension, and other take-up conditions, so usually a plurality of take-up rolls are used for taking up a ribbon.

As a take-up device using a plurality of take-up rolls, there is the carousel type of take-up device comprised of two or more take-up rolls magnetized on their surfaces.

When continuously taking up a cast ribbon by a plurality of take-up rolls, the take-up rolls have to be switched, but it has been considered difficult to instantaneously switch a take-up roll magnetized on its surface to another take-up roll to stably take up an amorphous ribbon. Therefore, Japanese Patent Publication (A) No. 11-28552 proposed to make the next high speed rotating take-up roll enter the pass line of the ribbon being taken up from below so as to make the take-up roll contact the ribbon, cut the ribbon at a limited position between the two take-up rolls, and then take up the ribbon at the next take-up roll. This proposal is a method of switching making a relationship between a distance L1 between the cutting position and the next take-up roll and the distance L2 between the next take-up roll and the cooling roll $L1 \geqq L2/20$ and further making the difference between the ribbon speed and the take-up roll speed within ±2 m/sec.

However, in the method disclosed in the above Japanese Patent Publication (A) No. 11-28552, the tip of the amorphous ribbon after being cut is caught by the next take-up roll, but sometimes the amorphous ribbon breaks right after being switched and other instances still arise where take-up cannot be continued. It was not possible to reliably switch the take-up rolls.

DISCLOSURE OF THE INVENTION

The present invention provides an amorphous ribbon take-up roll switching method and system which use a carousel type take-up device provided with a plurality of take-up rolls magnetized on their surfaces so as to take up an amorphous ribbon during which it is possible to simply and inexpensively switch take-up rolls reliably without the ribbon breaking.

The present invention was made to solve the above problem and has as its gist:

1) A method of taking up an amorphous ribbon having a magnetic property cast using a cooling roll by using two or more take-up rolls, said amorphous ribbon switching method characterized by, when switching the take-up rolls, bringing the amorphous ribbon into contact with the next take-up roll and cutting the amorphous ribbon being taken up in the state with the next take-up roll brought into proximity with the cooling roll or separating the next take-up roll and the cooling roll and cutting the amorphous ribbon between the take-up roll and the next take-up roll, then using the next take-up roll to take up the amorphous ribbon.

2) A method of taking up an amorphous ribbon having a magnetic property cast using a cooling roll by using two or more take-up rolls as set forth in 1), said amorphous ribbon switching method characterized by, when switching the take-up rolls, bringing the cast amorphous ribbon into contact with the next take-up roll in the advancing direction of the amorphous ribbon by pressing it by a plurality of holding rolls, then cutting said ribbon by a blade for cutting said ribbon provided between said holding rolls and switching to the next take-up roll.

3) A method of taking up an amorphous ribbon having a magnetic property cast using a cooling roll by using two or more take-up rolls as set forth in 1), said amorphous ribbon switching method characterized by, when switching the take-up rolls, bringing the amorphous ribbon into contact with the next take-up roll and cutting the amorphous ribbon being taken up in the state with the next take-up roll brought into proximity with the cooling roll, then using the next take-up roll to take up the amorphous ribbon.

4) A method of taking up an amorphous ribbon having a magnetic property cast using a cooling roll by using two or more take-up rolls as set forth in any one of 1) to 3), said amorphous ribbon switching method characterized by, when switching the take-up rolls, pressing the tip part of the amorphous ribbon after the switching by a guide device against the next take-up roll surface, then engaging it and switching the take-up rolls, 5) A method of taking up an amorphous ribbon having a magnetic property cast using a cooling roll by using two or more take-up rolls as set forth in 1), said amorphous ribbon switching method characterized by, when switching the take-up rolls, bringing the amorphous ribbon into contact with the next take-up roll, cutting the ribbon between the take-up roll and the next take-up roll, and, until the tip of the cut amorphous ribbon is engaged with the next take-up roll, pressing the tip of the cut amorphous ribbon against the surface of the next take-up roll by a guide device provided in proximity to the next take-up roll from the contact position with the amorphous ribbon in the circumferential direction of the next take-up roll to the position where the amorphous ribbon is engaged, then engaging the amorphous ribbon and switching the take-up roll.

6) An amorphous ribbon switching system in a take-up device taking up an amorphous ribbon having a magnetic property cast using a cooling roll by two or more take-up rolls magnetized at their surfaces, said amorphous ribbon switching system characterized by having a cutting mechanism which, when switching the take-up rolls, brings the cast amorphous ribbon into contact with the next take-up roll, then cuts the amorphous ribbon and by being provided with a guide device which is in proximity to the next take-up roll from the contact position with the amorphous ribbon in the circumferential direction of the next take-up roll to the position where the amorphous ribbon is engaged and presses the tip of the cut amorphous ribbon against the take-up roll surface.

7) An amorphous ribbon switching system in a take-up device taking up an amorphous ribbon having a magnetic property cast using a cooling roll by two or more take-up rolls magnetized at their surfaces as set forth in 6), said amorphous ribbon switching system characterized by having a plurality of holding rolls pressing the cast amorphous ribbon and bringing it into contact with the next take-up roll in the advancing direction of the amorphous ribbon when switching take-up rolls, providing a blade cutting said amorphous ribbon between said plurality of holding rolls, and providing a guide device which is in proximity to the next take-up roll from the contact position with the amorphous ribbon in the circumferential direction of the next take-up roll to the position where the amorphous ribbon is engaged and presses the tip of the cut amorphous ribbon against the take-up roll surface.

BRIEF DESCRIPTION OF THE DRAWINGS

FIG. 1(*b*) is a view showing the state of take-up in the steady state.

FIG. 1(*c*) is a view showing the state where the take-up device rotates for switching and an amorphous ribbon contacts the take-up roll.

FIG. 1(*d*) is a view showing the state where the take-up device moves and approaches a cooling roll.

FIG. 1(*e*) is a view showing the state of cutting the amorphous ribbon.

FIG. 1(*f*) is a view showing the state of engaging an amorphous ribbon tip part.

FIG. 1(*g*) is a view showing the state of switching to the next take-up roll.

FIG. 2(*b*) is a view showing the state where the take-up device rotates and the amorphous ribbon contacts the take-up roll.

FIG. 2(*c*) is a view showing the state of take-up in the steady state.

FIG. 2(*d*) is a view showing the state of cutting the amorphous ribbon.

FIG. 2(*e*) is a view showing the state of engaging the amorphous ribbon tip part.

FIG. 2(*f*) is a view showing the state of switching to the next take-up roll.

BEST MODE FOR CARRYING OUT THE INVENTION

Figure 1A:
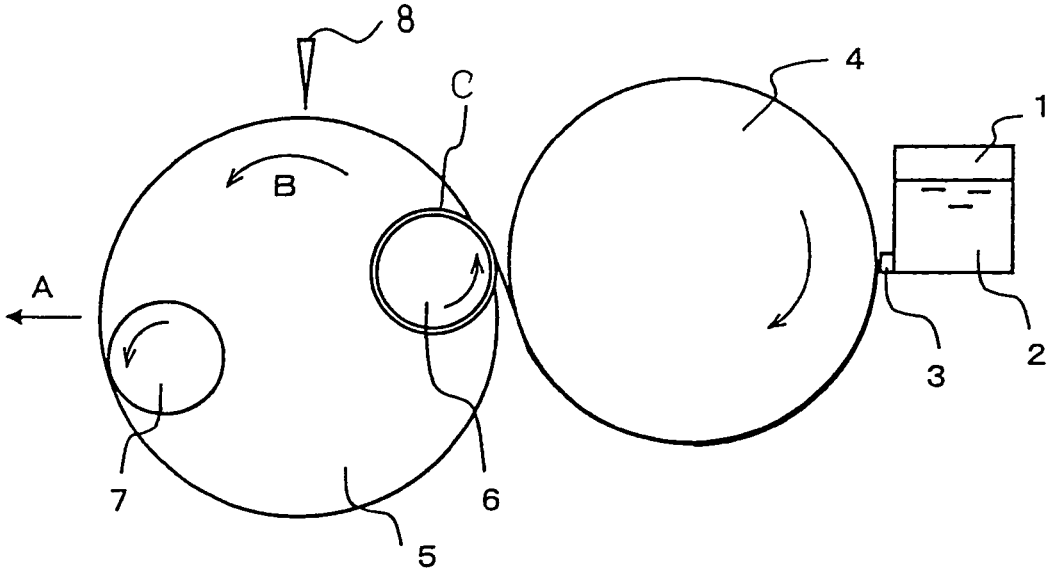
FIG. 1(*a*) is a view showing the state of start of take-up of an amorphous ribbon take-up roll switching method according to the present invention.
Figure 1B:
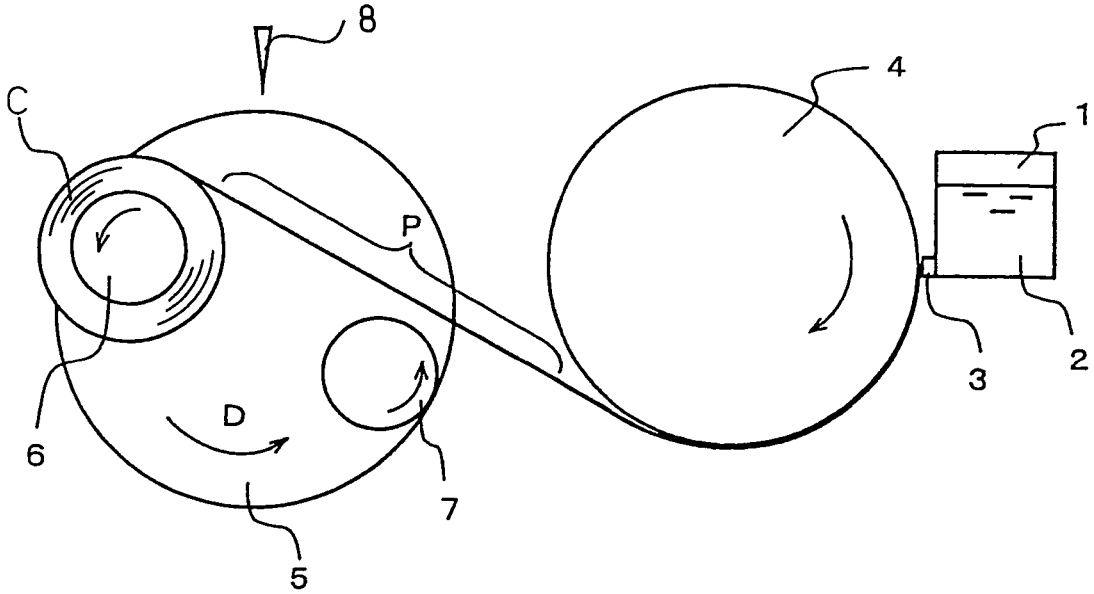
Figure 1C:
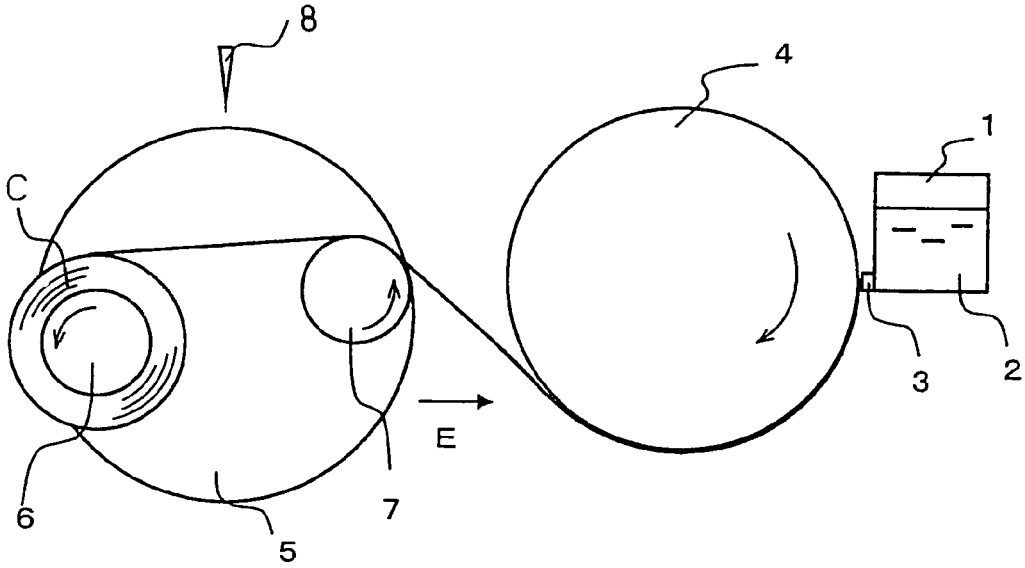
Figure 1D:
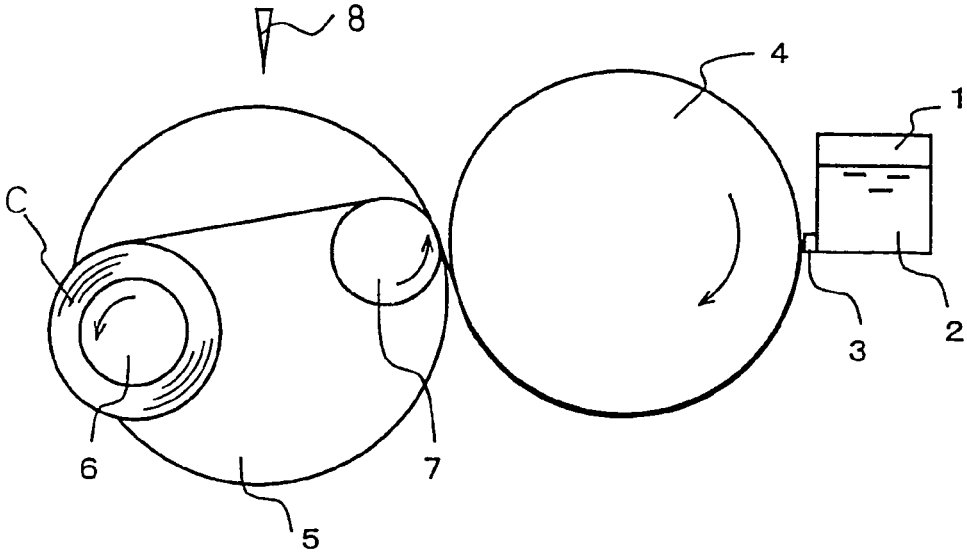
Figure 1E:
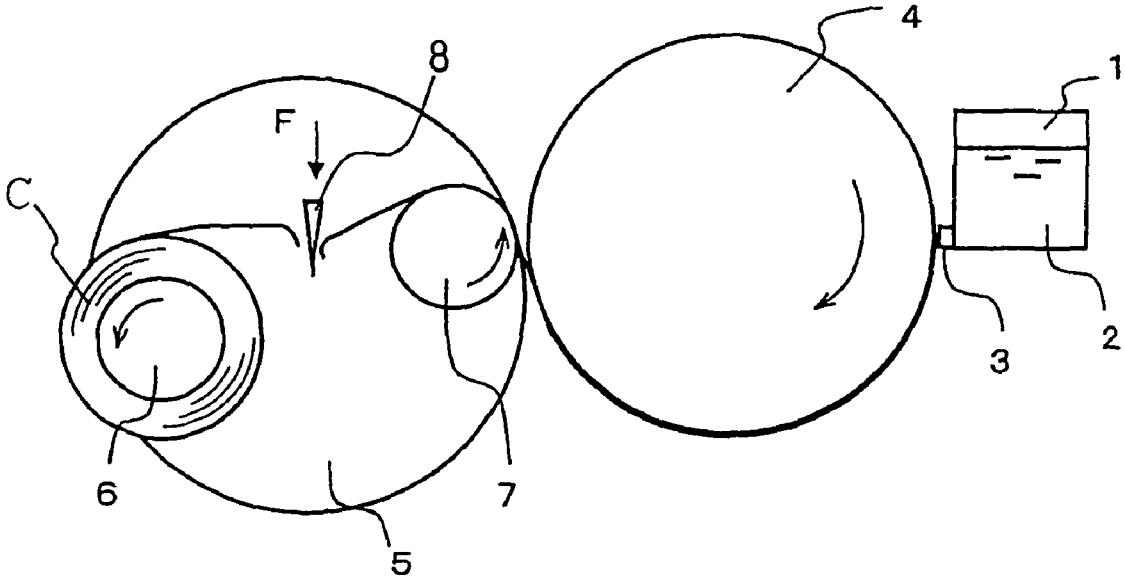
Figure 1F:
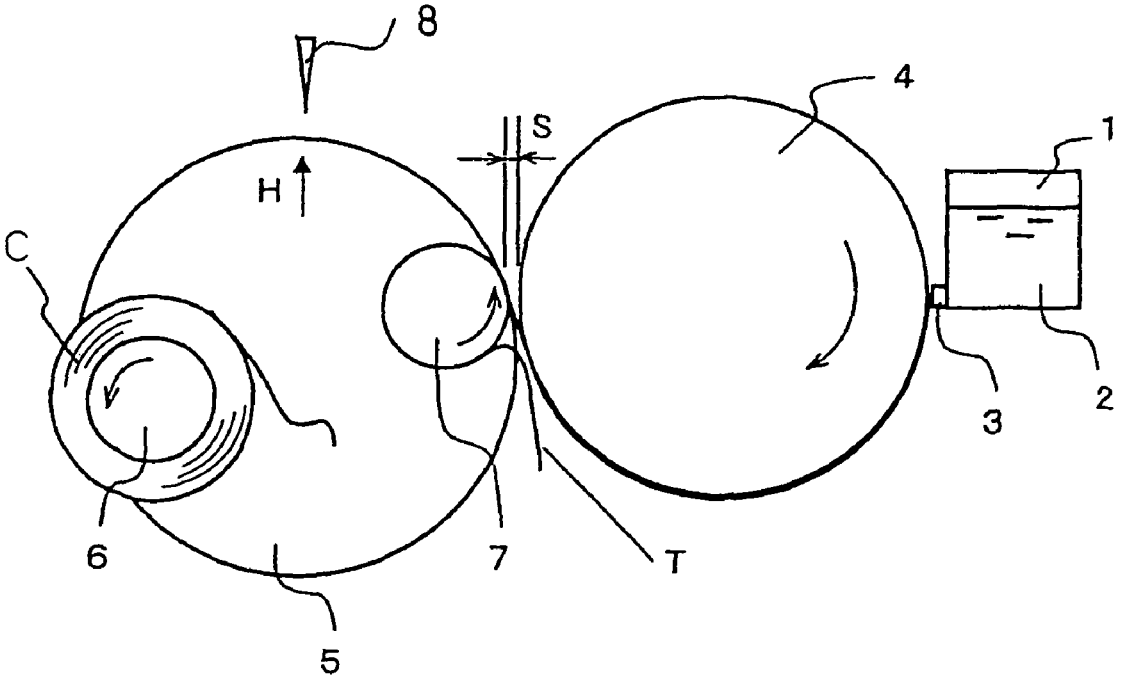
Figure 1G:
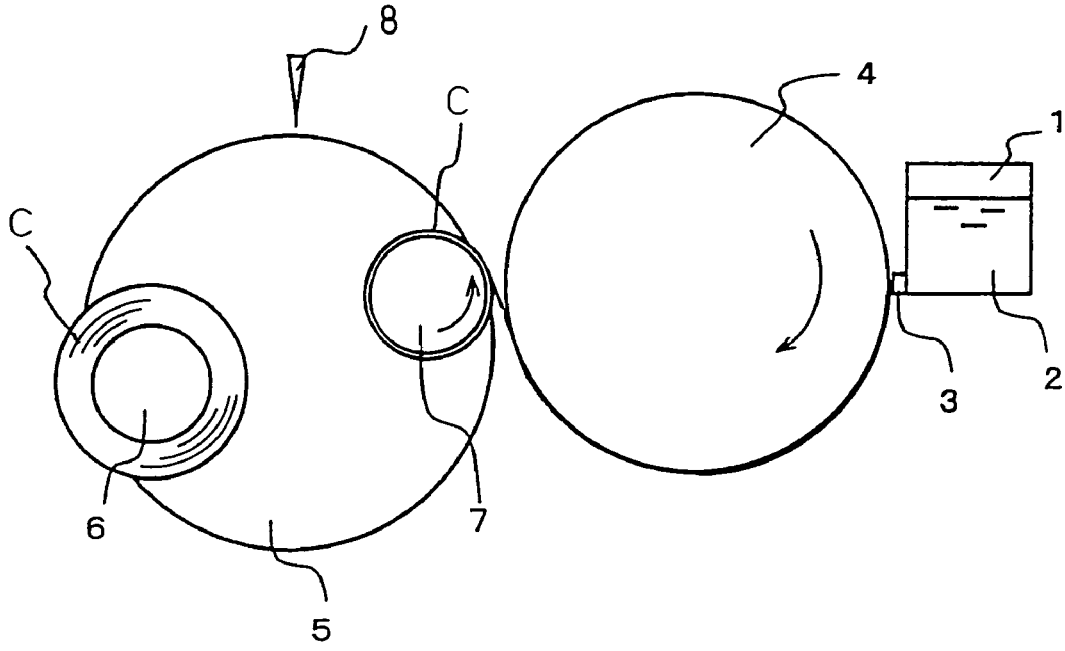
Figure 2A:
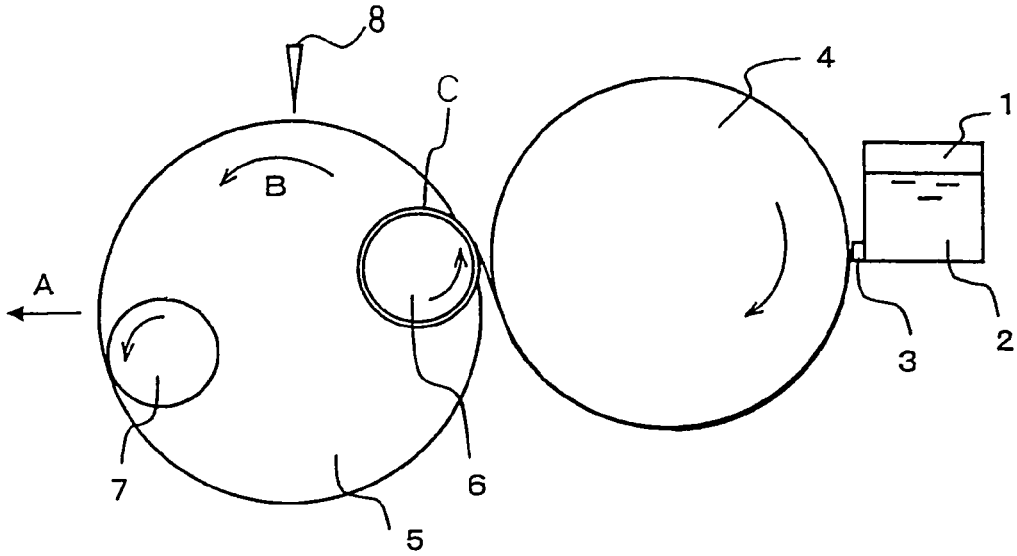
FIG. 2(*a*) is a view showing the state of start of take-up in the amorphous ribbon take-up roll switching method according to the present invention.
Figure 2B:
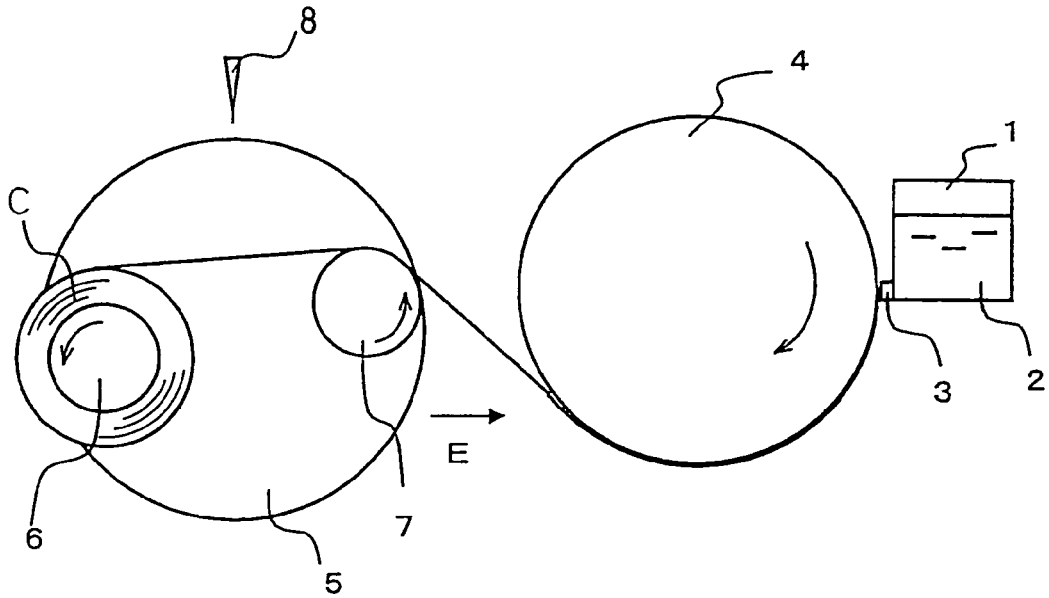
Figure 2C:
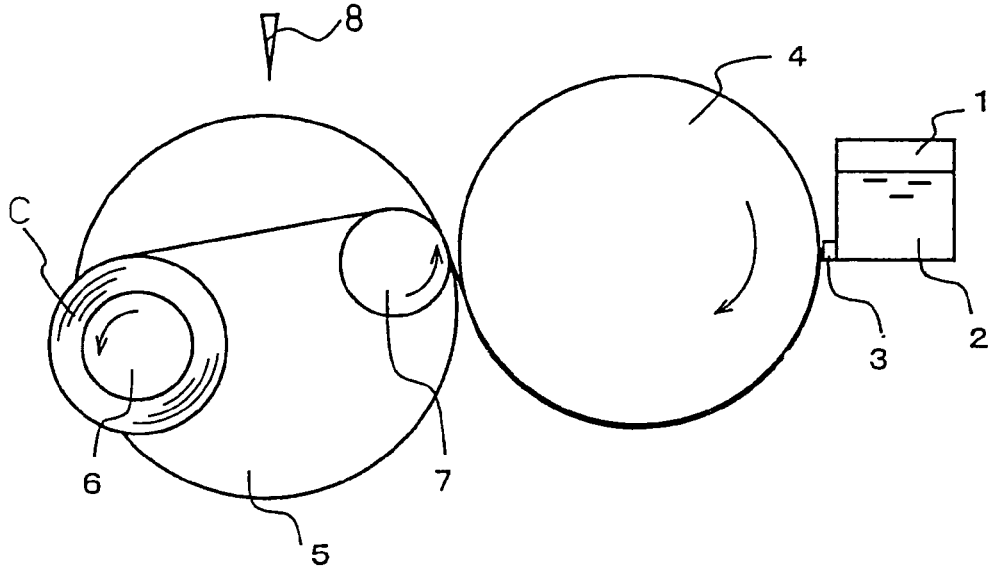
Figure 2D:
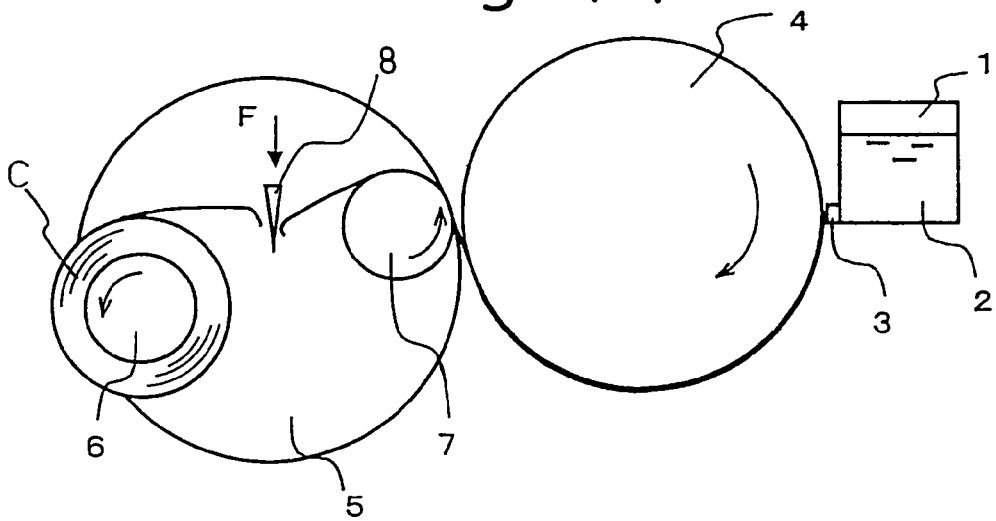
Figure 2E:
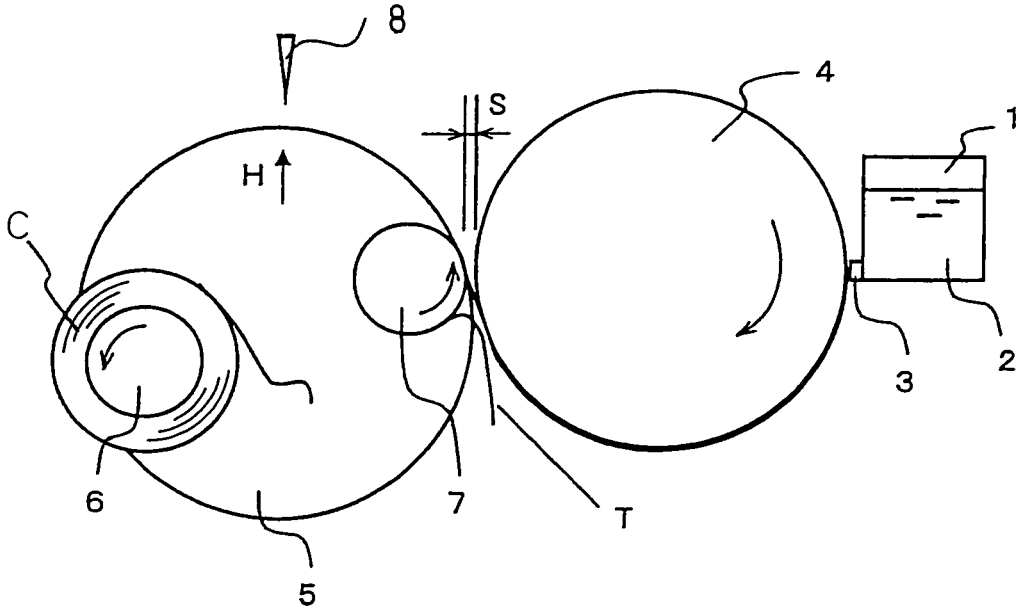
Figure 2F:
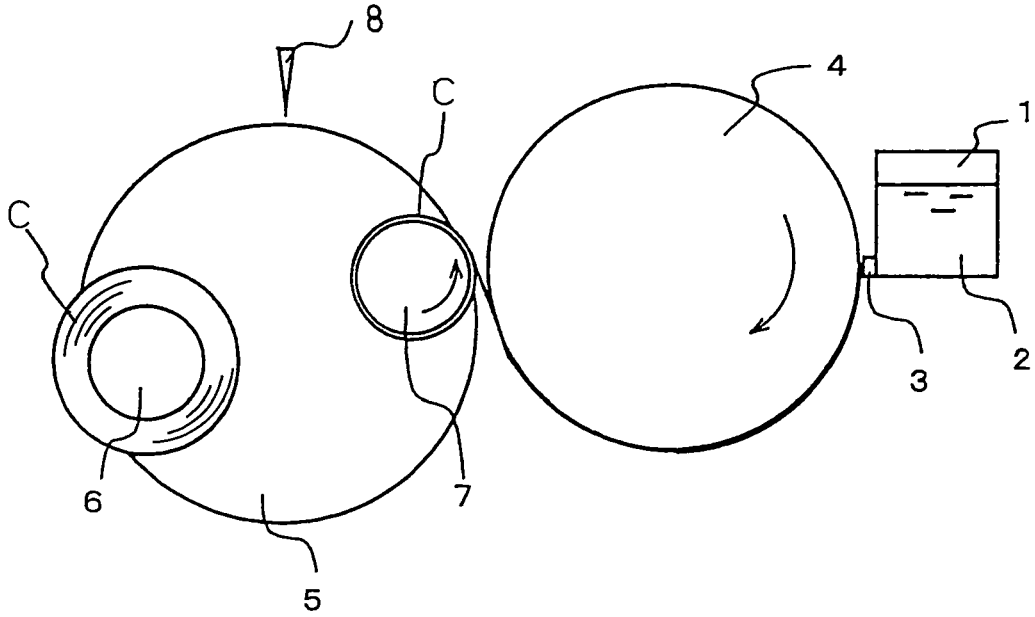

The present invention will be explained based on FIGS. 1(*a*) to (*g*) and FIGS. 2(*a*) to (*f*). FIGS. 1(*a*) to (*g*) are views showing the outlines of one aspect of the amorphous ribbon take-up roll switching method according to the present invention in the case of employing a carousel type take-up device provided with two take-up rolls. FIGS. 2(*a*) to (*f*) are views showing the outlines of another aspect of the amorphous ribbon take-up roll switching method according to the present invention in the case of employing said carousel type take-up device.

In FIG. 1(*a*), molten metal 2 in a tundish 1 is ejected through a nozzle 3 onto a surface of a high speed rotating cooling roll 4 so as to rapidly cool and solidify it and obtain an amorphous ribbon C which then starts to be taken up by a carousel type take-up device 5 set in proximity to the cooling roll 4. A space between the cooling roll 4 and the take-up roll 6 at the time of start of take-up should be as small as possible to enable a tip of the amorphous ribbon to be reliably caught while the rolls do not strike each other. The preferable range is 100 mm or less, more preferably 10 mm or less. This carousel type take-up device 5 has a structure enabling the ribbon to be alternately taken up by take-up rolls 6 and 7 provided at facing positions. After one take-up roll 6 takes up a certain fixed amount, the other facing take-up roll 7 is switched to for the take-up operation. These take-up rolls 6 and 7 have permanent magnets buried in their roll surfaces (magnetic force at take-up roll surfaces of at least 1000 G is preferable). Due to this magnetic force, they have the function of catching the tip of the amorphous ribbon C and then taking up the ribbon by rotation of the take-up rolls. Above this take-up device 5, a cutting device 8 is provided coupled with a separately provided drive mechanism (not shown).

In FIG. 1(*a*), the take-up device 5 uses the take-up roll 6 to catch the tip of the amorphous ribbon C, then moves in the direction of the arrow A to avoid contact with the cooling roll 4 due to take-up of the take-up roll 6 and interference between the take-up roll 6 and cooling roll 4 at the time of rotation of the take-up device 5, next rotates in the direction of the arrow B and continues to steadily take up the ribbon in the state of FIG. 1(*b*). At this time, the take-up roll 6 takes up the amorphous ribbon in the state where the facing next take-up roll 7 stands by before contacting the surface of the amorphous ribbon C in the pass line P created by the surface of the cooling roll 4 and the take-up roll 6. Here, the next take-up roll 7 is rotating in the direction of movement of the pass line P by a surface speed substantially equal to the speed of movement of the pass line P (amorphous ribbon C). When the take-up roll 6 takes up a predetermined amount of ribbon, the take-up rolls are switched. When switching, the amorphous ribbon C is made to contact the next take-up roll 7 by making the take-up device 5 rotate in the direction of the arrow D and stop at the position of FIG. 1(*c*). At this time, the stopped position of the next take-up roll 7 need only be one where the amorphous ribbon C contacts the take-up roll 7, but due to the magnetic force of the take-up rolls, contact by at least 50 mm is necessary. After this, the take-up device 5 is moved in the arrow E direction and, as shown in FIG. 1(*d*), is made to stop at a position in proximity to the cooling roll 4. At this time, the space S between the next take-up roll 7 of the take-up device 5 and the cooling roll 4 should be as small as possible to an extent not allowing collision. 1 mm to 200 mm is good, but the space is preferably 1 mm to 100 mm. At the position where the take-up roll 7 is in proximity to the cooling roll 4, as shown in FIG. 1(*e*), the cutting device 8 provided above the take-up device 5 moves in the direction of the arrow F and cuts the amorphous ribbon C between the take-up roll 6 and the take-up roll 7. The amorphous ribbon tip part T caught at this time, as shown in FIG. 1(*f*), bulges outward about due to the air resistance, but since the take-up roll 7 and the cooling roll 4 are in close proximity, the amorphous ribbon tip part T is folded back when passing through the space S between the take-up roll 7 and the cooling roll 4 and is engaged in the state in close contact with the take-up roll 7, therefore the amorphous ribbon is switched to the other roll without breakage as shown in FIG. 1(*g*). Note that the cutting device 8 moves in the direction of H immediately after cutting the ribbon and stands by above the take-up device 5 so as not to interfere with the equipment.

The inventors searched for the reasons why the amorphous ribbon broke and switching failed regardless of the amorphous ribbon being cut and the tip being caught stably. They installed a high speed video device and analyzed the state at the time of switching. As a result, they found that when this amorphous ribbon tip part T bulges out by a large extent, the amorphous ribbon breaks at the time of being engaged. Furthermore, by experiments, they discovered that if pressing this amorphous ribbon tip part T against the take-up roll 7, breakage can be avoided. Therefore, they discovered the method of bringing the take-up roll 7 and the cooling roll 4 into close proximity and stably pressing the ribbon tip part against the take-up roll when the amorphous ribbon tip T passes through this space S. This method utilizes the existing cooling roll 4 to press the amorphous ribbon tip part T against the take-up roll 7, so introduction of ancillary equipment for pressing purposes is not required and inexpensive, stable take-up becomes possible.

The take-up roll 6 having the taken up amorphous ribbon is pulled out by a take-up roll changing apparatus (not shown) and a new take-up roll is attached. The take-up roll 6 having the taken up amorphous ribbon is conveyed by a conveyor device (not shown) and sent on to the next process. After the new take-up roll is attached, this take-up roll 7 rotates in position and steadily takes up the ribbon at the position of the take-up roll 6 of FIG. 1(*b*). This series of processes is repeated to take up the ribbon on a predetermined number of rolls.

In another aspect of the present invention of FIGS. 2(*a*) to (*f*), in FIG. 2(*a*), the take-up device 5 uses the take-up roll 6 to catch the tip of the amorphous ribbon C, then moves in the direction of the arrow A, then rotates in the direction of the arrow B. As shown in FIG. 2(*b*), it stops at the position where the amorphous ribbon C contacts the next take-up roll 7, then moves in the arrow E direction and, as shown in FIG. 2(*c*), stops at the position in proximity to the cooling roll 4. In the state of this FIG. 2(*c*), it continues steadily taking up the ribbon. When the take-up roll 6 takes up a predetermined amount of the ribbon, the take-up rolls are switched. As shown in FIG. 2(*d*), the cutting device 9 provided above the take-up device 5 cuts the amorphous ribbon C between the take-up roll 6 and the take-up roll 7. The amorphous ribbon tip part T, as shown in FIG. 2(*e*), is folded back when passing through the space S between the take-up roll 7 and the cooling roll 4 and is engaged in the state in close contact with the take-up roll 7, whereby, as shown in FIG. 2(*f*), the amorphous ribbon is switched to another roll without breakage.

The take-up roll 6 taking up the amorphous ribbon is pulled out by a take-up roll changing apparatus (not shown) and a new take-up roll is attached. The take-up roll 6 taking up the amorphous ribbon is conveyed by a conveyor device (not shown) and sent on to the next process. After the new take-up roll is attached, this take-up device 5 moves and rotates, passes through FIG. 2(*b*), and continues to steadily take up the ribbon in the state of FIG. 2(*c*). This series of processes is repeated to take up the ribbon on a predetermined number of rolls.

FIGS. 1(*a*) to (*g*) and FIGS. 2(*a*) to (*f*) were used to explain the present invention, but it is also conceivable to make the steady take-up position FIG. 2(*b*) or to change the take-up rolls after take-up after movement in the arrow A in FIG. 1(*a*). All methods which bring the amorphous ribbon into contact with the take-up roll 7, make the take-up roll 7 and cooling roll 4 approach each other, then cut the amorphous ribbon 8 are included in the present invention. Further, when separating the next take-up roll and the cooling roll to cut the amorphous ribbon between the take-up roll and the next take-up roll and using the next take-up roll to take up the amorphous ribbon, the next method is used.

Figure 3:
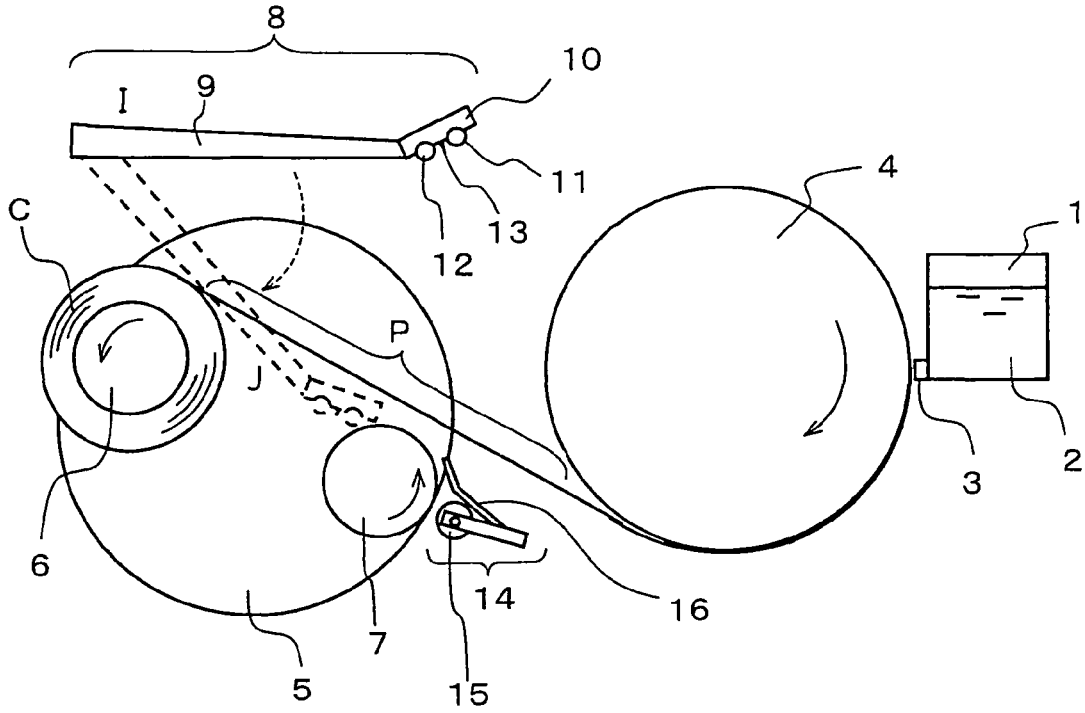
FIG. 3 is a schematic view showing an amorphous ribbon take-up roll switching system according to the present invention (side view).
Figure 4:
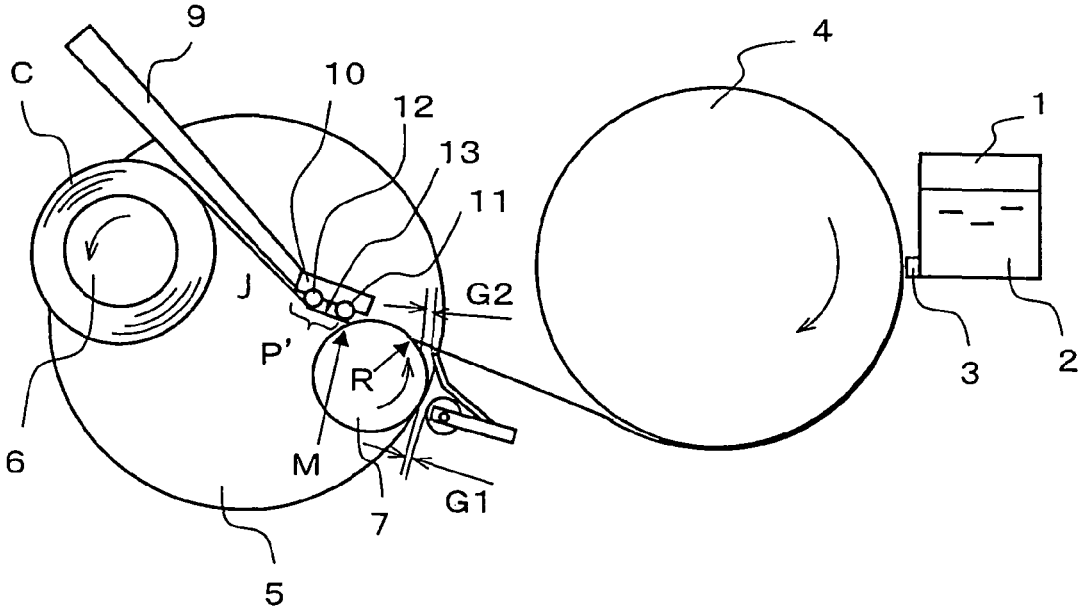
FIG. 4 is a schematic view showing the state of switching take-up rolls according to the present invention (side view).
Figure 5:
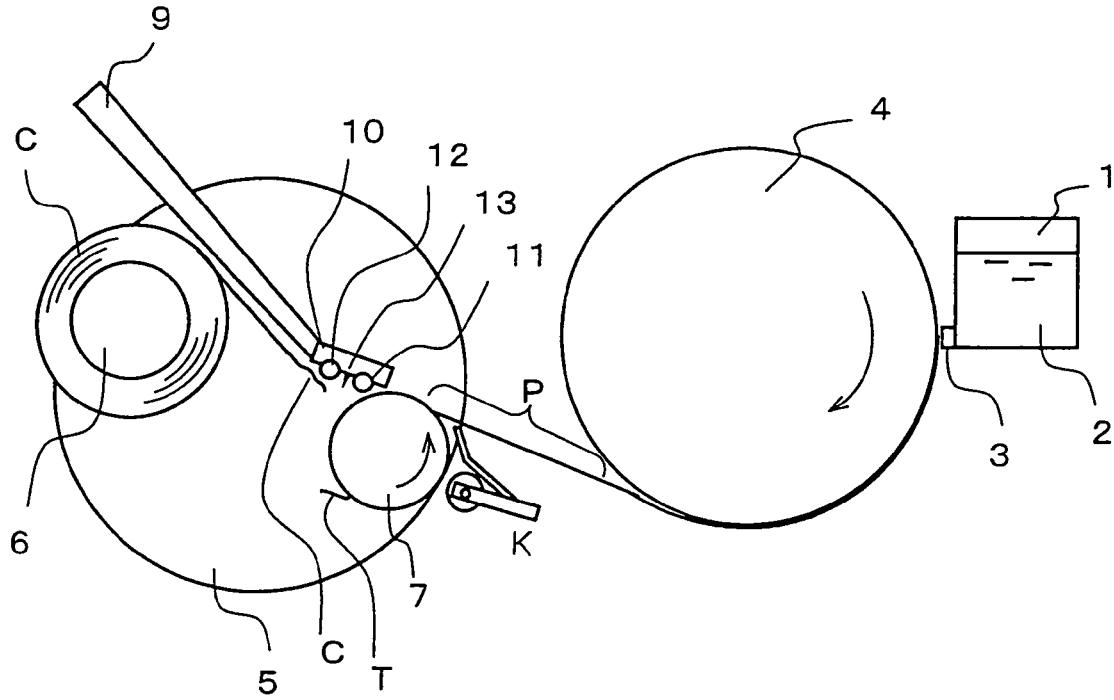
FIG. 5 is a schematic view showing the state of cutting the amorphous ribbon at the time of switching the take-up rolls according to the present invention (side view).
Figure 6:
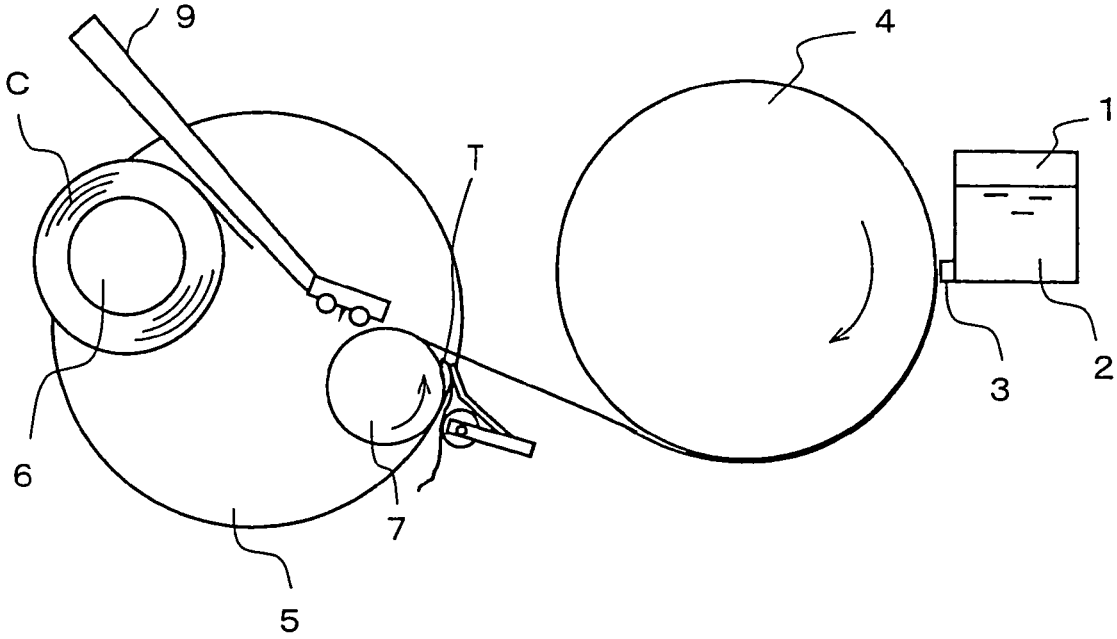
FIG. 6 is a schematic view showing the state of take-up right after taking up an amorphous ribbon according to a take-up roll switched by the present invention (side view).
Figure 7:
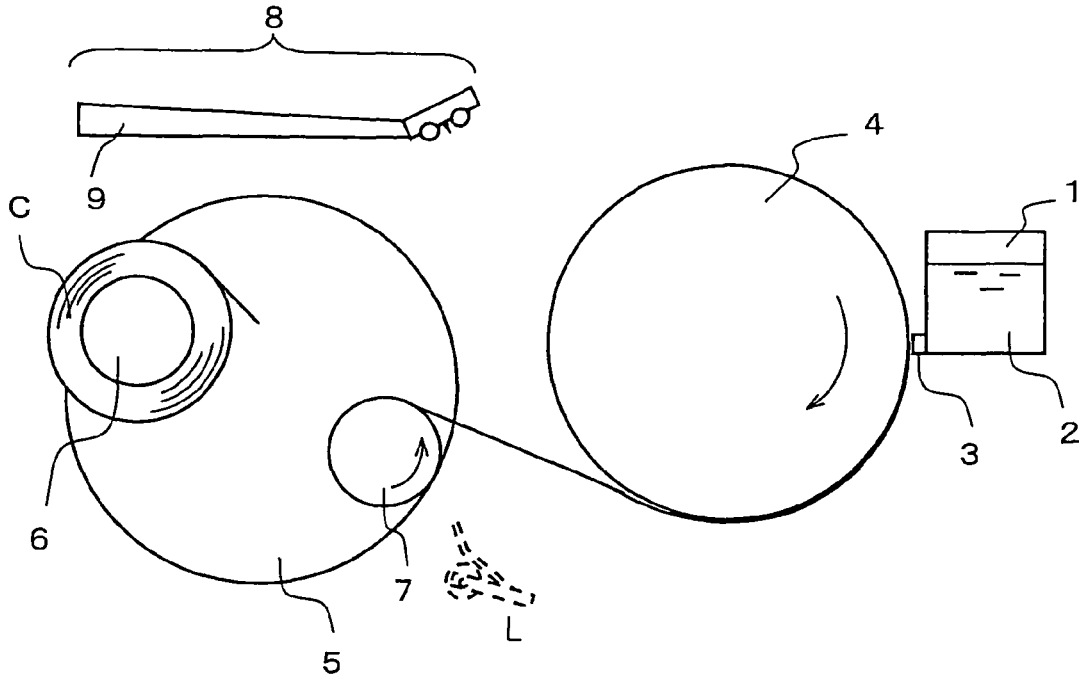
FIG. 7 is a schematic view showing the state of take-up according to a take-up roll switched by the present invention (side view).
Figure 8:
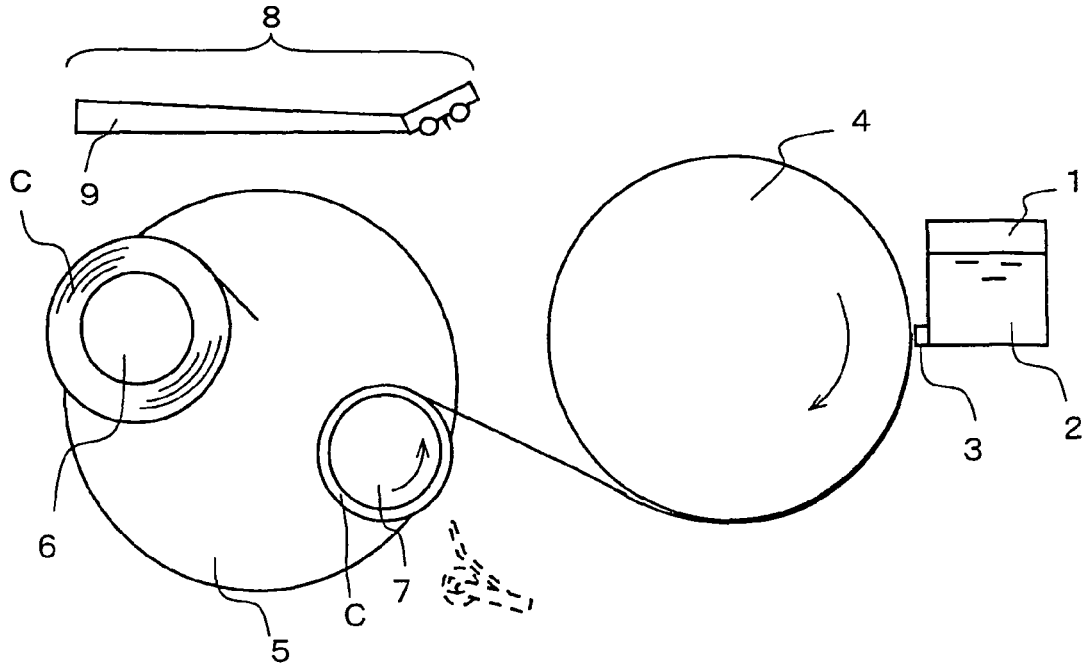
FIG. 8 is a schematic view showing the state of continuation of take-up according to a take-up roll switched by the present invention (side view).

FIG. 3 is a schematic view showing an example of the general configuration of an amorphous ribbon take-up roll switching system according to the present invention in the case of employing a carousel type device provided with two take-up rolls. FIG. 4 is a schematic view showing the state where an amorphous ribbon being taken up is made to contact the next take-up roll by holding rolls (in FIGS. 3 to 8, the example of two holding rolls arranged in the advancing direction of the amorphous ribbon is shown), FIG. 5 is a schematic view showing the state of cutting the amorphous ribbon by a cutting blade, FIG. 6 is a schematic view showing the state after cutting the amorphous ribbon, using the next take-up roll to catch the amorphous ribbon tip, using a guide device to press the amorphous ribbon tip against the take-up roll surface, then engaging the ribbon tip and starting take-up, FIG. 7 is a schematic view showing the state with the holding rolls and the guide device retracted, and FIG. 8 is a schematic view showing the state using the next take-up roll to start take-up. FIGS. 3 to 8 will be used to explain the process of switching take-up rolls.

In FIG. 3, molten metal 2 in a tundish 1 is ejected through a nozzle 3 onto a surface of a high speed rotating cooling roll 4 so as to rapidly cool and solidify it and obtain an amorphous ribbon C which then starts to be taken up by a carousel type take-up device 5 set in proximity to the cooling roll 4. This carousel type take-up device 5 has a structure enabling the ribbon to be alternately taken up by take-up rolls 6 and 7 provided at facing positions. After one take-up roll 6 takes up a certain fixed amount, the other facing take-up roll 7 is switched to for the take-up operation. These take-up rolls 6 and 7 have permanent magnets buried in their roll surfaces. Due to this magnetic force, they have the function of catching the tip of the amorphous ribbon C and then taking up the ribbon by rotation of the take-up rolls.

Figure 9:
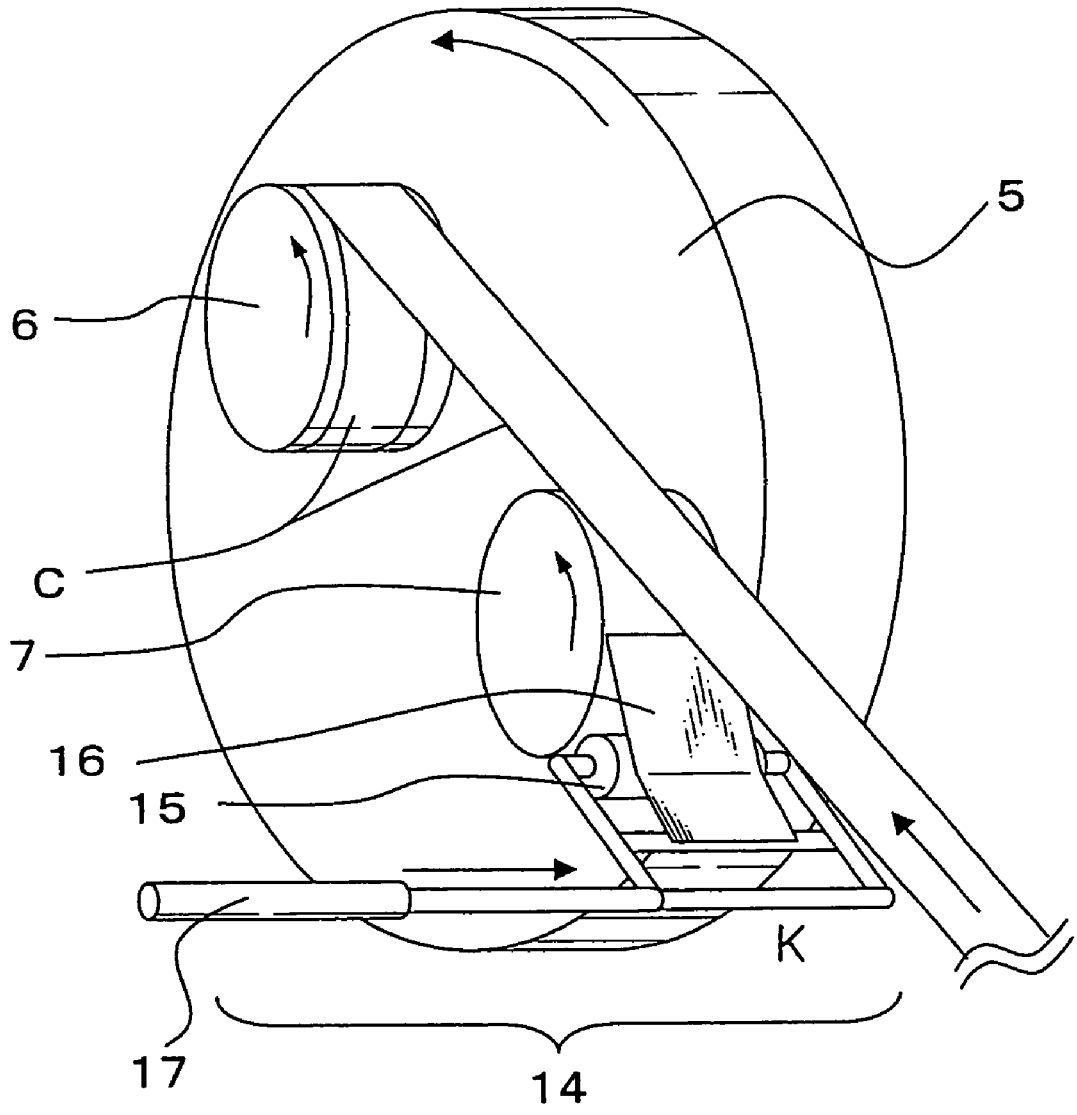
FIG. 9 is a schematic view showing a guide position of a guide device according to the present invention.
Figure 10:
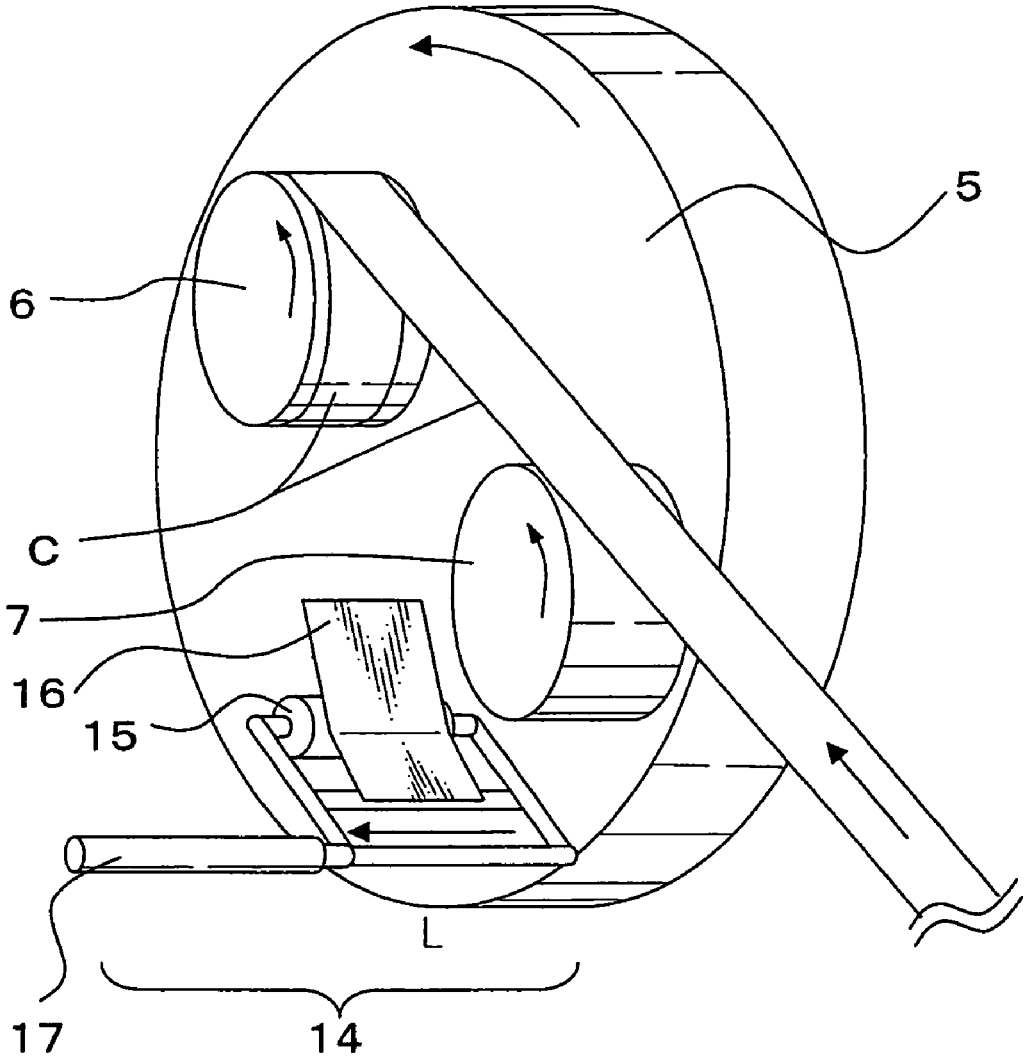
FIG. 10 is a schematic view showing a retracted position of a guide device according to the present invention.
Figure 11:
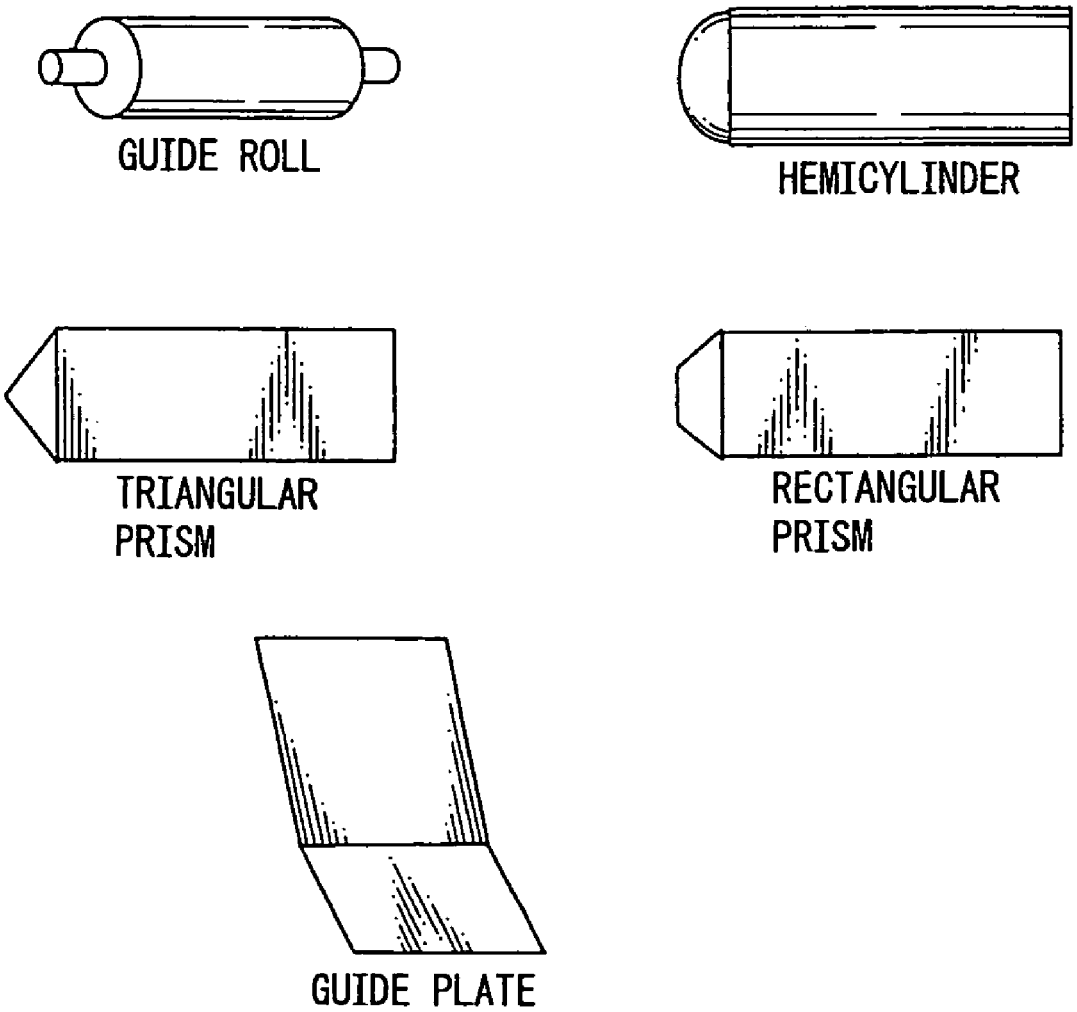
FIG. 11 is a schematic view showing another example of a guide device according to the present invention.

At the next take-up roll 7, as shown in FIG. 4, a guide device 14 is provided in proximity to the take-up roll 7 from a contact position M with the amorphous ribbon in the circumferential direction to a position R where the amorphous ribbon is engaged. This guide device 14 has a movement mechanism 17 so as, as shown in FIG. 10, to retract to the retracted position in the axial direction of the take-up rolls 6 and 7 so as not to interface with the equipment at the time of start of take-up or when the carousel type take-up device 5 is rotating after switching take-up rolls and so as, as shown in FIG. 9, to move to the guide position K in proximity to the take-up roll 7 when continuing to steadily take up the ribbon at the position of the take-up roll. In the present example, the example of movement in the axial direction of the take-up roll was shown, but the movement mechanism is not limited so long as moving in the vertical direction with respect to the take-up roll surface or otherwise not interfering with the equipment. The guide device 14 is configured by a guide roll 15 for pressing the amorphous ribbon tip part T shown in FIG. 5 against the surface of the take-up roll 7 and a guide plate 16 for introducing the amorphous ribbon tip part T after passing the guide roll 15 to the engagement part R of the next take-up roll 7 (see FIG. 3). This guide roll 15 and guide plate 16 are more preferably made of aluminum or another nonmagnetic material so as not to be influenced by the permanent magnets buried in the take-up roll surfaces, but magnetic materials may also be used. The gap G1 between the guide roll 15 and the take-up roll 7 and the gap G2 of the guide plate 16 are made 1 mm to 200 mm, preferably 1 mm to 100 mm. The reason for making the gap G1 the above range is that if the gap G1 becomes more than 200 mm, the effect of pressing the amorphous ribbon tip part L against the take-up roll 7 will become smaller, while if less than 1 mm, it will become difficult for the amorphous ribbon tip part T to pass the guide roll 15 and guide plate 16. This was found experimentally. Further, the guide roll 15 and the guide plate 16 should have widths of at least the width of the amorphous ribbon. The roll diameter and the plate thickness are not particularly limited, but it is necessary to prevent insufficient strength or interference with equipment. In the present example, as the guide device 14 for pressing the amorphous ribbon tip part T against the surface of the take-up roll 7, the guide roll 15 and the guide plate 16 were used, but a shape pressing the amorphous ribbon tip part T against the take-up roll 7, for example a guide roll as shown in FIG. 11, a hemicylinder, triangular prism, rectangular prism, guide plate, or other shape may also be provided alone (a structure where the space at the side for entry of the amorphous ribbon is wide and gradually becomes narrower is preferable). A plurality of these shapes may also be provided in combination. However, suitable gaps are set in advance by experiments.

Above the take-up device 5 of FIG. 3, a cutting device 8 is provided coupled with a separately provided drive mechanism (not shown). This cutting device 8 is comprised of an arm 9 at the tip of which is connected a cutting mechanism 10 including two holding rolls 11 and 12 arranged in the advancing direction of the amorphous ribbon and a cutting blade 13 positioned at substantially the middle of these holding rolls 11 and 12 and in a direction entering the ribbon pass line P from above. The two holding rolls 11 and 12 have shafts parallel with the shafts of the take-up rolls 6 and 7 and have widths the same as the take-up rolls 6 and 7. The widths of the holding rolls 11 and 12 should be at least the width of the amorphous ribbon C so as to stably press the ribbon. The diameters of the holding rolls should be made not more than the stroke of the cutting blade 13. Further, said cutting device 8 is configured to swing in an arc so as to approach the take-up roll 6 at the time of cutting the ribbon C. In the present example, the cutting device 8 is made to swing in an arc, but it is also possible to drive it in the vertical direction to approach the take-up roll 6.

In the take-up process of FIG. 3, in the steady state, the take-up roll 6 takes up the amorphous ribbon C in the state where the facing next take-up roll 7 stands by before contacting the surface of the amorphous ribbon C in the pass line P created by the surface of the cooling roll 4 and the take-up roll 6. Here, the take-up roll 7 is rotating in the direction of movement of the pass line P by a surface speed substantially equal to the speed of movement of the pass line P (amorphous ribbon C). At the next take-up roll 7, a guide device 14 stands by in proximity to the take-up roll 7 from a contact position with the amorphous ribbon in the circumferential direction to a position where the amorphous ribbon is engaged. In the steady state, this guide device 14 moves from the retracted position L shown in FIG. 10 to the guide position K shown in FIG. 9.

Next, as shown in FIG. 4, at the point of time when the take-up roll 6 takes up a certain fixed amount of the amorphous ribbon C, the cutting device 8 is swung from above the middle of the take-up roll 6 and the next take-up roll 7 from the position of I to the position of J in an arc. The two holding rolls 11 and 12 housed in the cutting mechanism 10 press the amorphous ribbon C and make the amorphous ribbon C contact the next take-up roll 7 by ½ or less of the circumferential length of the take-up rolls, preferably at least 50 mm. At this time, by providing a plurality of holding rolls (in the present example, the two holding rolls 11 and 12), regardless of the amount of ribbon taken up by the take-up roll 6 and, furthermore, regardless of the size of the cooling roll 4 (in normal use, for grinding and polishing, the size of the cooling roll 4 is reduced), the pass line P' of the cut part of the amorphous ribbon formed by the holding rolls 11 and 12 constantly becomes a fixed positional relationship.

Furthermore, as shown in FIG. 5, the cutting blade 13 provided between the holding rolls 11 and 12 brought into contact with the amorphous ribbon C is operated by a separately provided cutting blade raising and lowering mechanism (not shown) to make the cutting blade descend and contact and cut the amorphous ribbon C, but since the pass line P' of the amorphous ribbon is constantly in a fixed positional relationship, the relationship between the amorphous ribbon and the cutting blade 13 also becomes fixed and the amorphous ribbon is stably cut.

The tip of the cut amorphous ribbon C, as shown in FIG. 5, is caught at the surface of the next take-up roll 7 by the magnetic force. Here, the reason for making the amorphous ribbon C contact ½ or less of the circumferential length of the take-up roll is that making it contact more than ½ of the circumferential length of the cooling roll would make not only descent of the arm 9, but also an extension mechanism necessary and otherwise would complicate the equipment and result in a high price. Further, the reason for contact by at least 50 mm as a preferable length is that it was discovered experimentally that with a take-up roll magnetized at its surface (magnetic force at surface of 1000 G or more), contact by 50 mm or more of the amorphous ribbon would enable the tip of amorphous ribbon to be caught 100% of the time.

The tip part T of the amorphous ribbon caught at this time, as shown in FIG. 5, is folded back by the air resistance. This tip part T, as shown in FIG. 6, is guided by the guide device 14 and pressed against the take-up roll 7 by the guide roll 15 and furthermore pressed by the guide plate 16 against the take-up roll 7 whereby the amorphous ribbon is guided to the engagement part R and the amorphous ribbon tip is engaged.

The inventors investigated the reason why despite the amorphous ribbon being cut and the tip being caught stably, when the casting speed or the plate thickness etc. was changed, the amorphous ribbon broke and failed to be switched between rolls. They set a high speed video device and analyzed the state of switching and as a result discovered that this was due to the folded back shape of the amorphous ribbon tip part T. That is, they discovered that when this folded back tip part T greatly bulges outward, the amorphous ribbon breaks at the engagement part R of the amorphous ribbon. For this reason, the inventors learned that by pressing this tip part by the guide roll 15 against the take-up roll 7 to prevent the folded back part of the amorphous ribbon tip part T from bulging out and furthermore guiding the amorphous ribbon pressed by the guide plate 16 against the take-up roll 7 to the engagement part R, the rolls can be switched without ribbon breakage under all conditions.

After the next take-up roll 7 engages the amorphous ribbon tip, as shown in FIG. 7, the cutting device 8 retracts and returns to its original position. The guide device 14 also, as shown in FIG. 10, retracts to the retracted position L so as not to interfere with the equipment. As shown in FIG. 8, when the take-up roll 7 starts take-up, the take-up roll 6 with the taken up amorphous ribbon is pulled out by a take-up roll changing apparatus (not shown) and a new take-up roll is attached. The take-up roll 6 with the taken up amorphous ribbon is conveyed by a conveyor device (not shown) and sent to the next process. After the new take-up roll is attached, this take-up roll 7 rotates in position and steadily takes up the ribbon at the position of the take-up roll 6. This series of processes is repeated to continue taking up the ribbon.

EXAMPLE 1

As an example of the present invention, the inventors cast an amorphous ribbon comprised of, by atm %, Fe: 80.5%, B: 15.0%, Si: 3.0%, C: 1.0%, and a balance of unavoidable impurities and used the device shown in FIG. 1 to switch take-up rolls while changing the casting speed and ribbon thickness. The nozzle used for the casting had an opening of a shape of 170 mm×0.85 mm. The molten metal was ejected on to the surface of an internal water-cooled type cooling roll made of a copper alloy so as to obtain an amorphous ribbon. Note that the cooling roll was made one with a diameter ϕ of 1198 mm, a width of 250 mm, and a wall thickness of 19 mm.

Further, the take-up rolls were made ones of a diameter ϕ of 600 mm, a width of 375 mm, a magnetic force at the surface of 2000 G. The positions of the take-up rolls at the time of switching, from the viewpoint of streamlining the equipment and control, were set so that the position of the next take-up roll 7 became a position the same as the take-up roll 6 at the time of start of take-up. The contact length between the amorphous ribbon and take-up roll in this case was 30 cm.

As comparative examples, the inventors cast and took up amorphous ribbons setting L1=30 cm, L2=5 m by the method shown in Japanese Patent Publication (A) No. 11-28552 and otherwise under the same casting conditions as the invention examples and tried switching take-up rolls. In both the invention examples and comparative examples, the width of the ribbon taken up by the take-up rolls was made about 200 mm and the casting speeds and ribbon thicknesses were changed for switching operations. The results are shown in Table 1.

TABLE 1

| Class | No. | Casting speed (m/s) | Plate thickness (μm) | Switching ability |
|---|---|---|---|---|
| Inv. ex. | 1 | 20 | 25.3 | Good |
| | 2 | 20 | 31.3 | Good |
| | 3 | 22 | 25.8 | Good |
| | 4 | 22 | 30.0 | Good |
| | 5 | 24 | 25.6 | Good |
| | 6 | 24 | 30.3 | Good |
| | 7 | 26 | 25.1 | Good |
| | 8 | 26 | 30.0 | Good |
| | 9 | 28 | 25.9 | Good |
| | 10 | 30 | 24.3 | Good |
| Comp. ex. | 11 | 20 | 25.3 | Good |
| | 12 | 20 | 31.2 | Good |
| | 13 | 22 | 26.4 | Good |
| | 14 | 22 | 30.4 | Good |
| | 15 | 24 | 26.0 | Good |
| | 16 | 24 | 30.7 | Poor |
| | 17 | 26 | 25.5 | Poor |
| | 18 | 26 | 30.4 | Poor |
| | 19 | 28 | 26.3 | Poor |
| | 20 | 30 | 24.7 | Poor |

[Legend] Good: Amorphous ribbon cut and tip caught well and amorphous ribbon able to be switched without breaking
Poor: Amorphous ribbon cut and tip caught well, but amorphous ribbon broke at time of engagement and not able to be switched In the Invention Example Nos. 1 to 10, even if the casting speed and ribbon thickness fluctuated, the take-up rolls could be switched without problem, but in Comparative Example Nos. 11 to 20, when the casting speed was slow, switching was possible regardless of the ribbon thickness, but when the casting speed becomes faster or the ribbon thickness becomes greater, the amorphous ribbon could be cut and the tip could be caught well, but the amorphous ribbon broke when being engaged with and the take-up rolls could not be switched.

EXAMPLE 2

As an example of the present invention, the inventors cast an amorphous ribbon comprised of, by atm %, Fe: 80.5%, B: 15.0%, Si: 3.0%, C: 1.0%, and a balance of unavoidable impurities and used the device shown in FIG. 3 to switch take-up rolls while changing the casting speed and ribbon thickness. The nozzle used for the casting had an opening of a shape of 170 mm×0.85 mm. The molten metal was ejected onto the surface of an internal water-cooled type cooling roll made of a copper alloy so as to obtain an amorphous ribbon. Note that the cooling roll was made one with a diameter ϕ of 1198 mm, a width of 250 mm, and a wall thickness of 19 mm. Further, the take-up rolls were made ones of a diameter ϕ of 600 mm, a width of 375 mm, a magnetic force 5 mm from the surface of 350 G or more, and a contact length of 30 cm. The guide device, as shown in FIG. 9, was made a structure combining a guide roll and guide plate. The guide roll was made of aluminum and had a width of 200 mm, a roll diameter ϕ of 60 mm, and a gap from the take-up roll of 15 mm. The guide plate was made of aluminum and had a width of 200 mm and a length of 300 mm. The gap between the guide plate at the exit of the guide plate and the take-up roll was made 5 mm.

As comparative examples, the inventors cast and took up amorphous ribbons setting L1=30 cm, L2=5 m by the method shown in Japanese Patent Publication (A) No. 11-28552 and otherwise under the same casting conditions as the invention examples and tried switching take-up rolls.

In both the invention examples and comparative examples, the width of the ribbon taken up by the take-up rolls was made about 200 mm and the casting speeds and ribbon thicknesses were changed for switching operations. The results are shown in Table 2.

TABLE 2

| Class | No. | Casting speed (m/s) | Plate thickness (μm) | Switching ability |
|---|---|---|---|---|
| Inv. ex. | 1 | 20 | 25.5 | Good |
| | 2 | 20 | 31.5 | Good |
| | 3 | 22 | 26 | Good |
| | 4 | 22 | 30.2 | Good |
| | 5 | 24 | 25.8 | Good |
| | 6 | 24 | 30.5 | Good |
| | 7 | 26 | 25.3 | Good |
| | 8 | 26 | 30.2 | Good |
| | 9 | 28 | 26.1 | Good |
| | 10 | 30 | 24.5 | Good |
| Comp. ex. | 11 | 20 | 25.1 | Good |
| | 12 | 20 | 31 | Good |
| | 13 | 22 | 26.2 | Good |
| | 14 | 22 | 30.2 | Good |
| | 15 | 24 | 25.8 | Good |
| | 16 | 24 | 30.5 | Poor |
| | 17 | 26 | 25.3 | Poor |
| | 18 | 26 | 30.2 | Poor |
| | 19 | 28 | 26.1 | Poor |
| | 20 | 30 | 24.5 | Poor |

[Legend] Good: Amorphous ribbon cut and tip caught well and amorphous ribbon able to be switched without breaking
Poor: Amorphous ribbon cut and tip caught well, but amorphous ribbon broke at time of engagement and not able to be switched In Invention Example Nos. 1 to 10, even if the casting speed and ribbon thickness fluctuated, the take-up rolls could be switched without problem, but in Comparative Example Nos. 11 to 20, when the casting speed was slow, switching was possible regardless of the ribbon thickness, but when the casting speed became faster or the ribbon thickness became greater, the amorphous ribbon could be cut and the tip could be caught well, but the amorphous ribbon broke when being engaged with and the take-up rolls could not be switched.

INDUSTRIAL APPLICABILITY

The present invention switches take-up rolls in a take-up device comprised of two or more take-up rolls magnetized at their surfaces during which it brings the amorphous ribbon into contact with the next take-up roll and cuts the amorphous ribbon being taken up in the state with the next take-up roll brought into proximity with the cooling roll, so it is possible to prevent breakage of the amorphous ribbon which used to occur right after switching and obtain reliable switching. Further, the present invention can provide an amorphous ribbon take-up roll switching method and switching system in a take-up device comprised of two or more take-up rolls magnetized at their surfaces wherein, when switching take-up rolls, before the tip of the cut amorphous ribbon is engaged with the next take-up roll, the tip of the cut amorphous ribbon is engaged after being pressed by the guide device against the surface of the next take-up roll from the contact position with said amorphous ribbon at the circumferential direction of the next take-up roll to the position where the amorphous ribbon is engaged, so it is possible to prevent breakage of the amorphous ribbon which used to occur right after switching and obtain reliable switching.

DESCRIPTION OF REFERENCES

| | |
|---|---|
| 1 | tundish |
| 2 | the molten metal |

-continued

DESCRIPTION OF REFERENCES

| | |
|---|---|
| 3 | nozzle |
| 4 | cooling roll |
| 5 | carousel type take-up device |
| 6 | take-up roll |
| 7 | take-up roll |
| 8 | cutting device |
| 9 | arm |
| 10 | cutting mechanism |
| 11 | holding roll |
| 12 | holding roll |
| 13 | cutting blade |
| 14 | guide device |
| 15 | guide roll |
| 16 | guide plate |
| 17 | movement mechanism of guide position |
| A | equipment movement direction |
| B | equipment movement direction |
| C | amorphous ribbon |
| D | equipment movement direction |
| E | equipment movement direction |
| F | equipment movement direction |
| H | equipment movement direction |
| P | pass line |
| P' | pass line |
| S | space between take-up roll and cooling roll |
| T | amorphous ribbon tip part after cutting |
| I | cutting device standby position |
| J | cutting device operating position |
| K | guide position of guide device |
| L | retracted position of guide device |
| G1 | gap between guide roll and take-up roll |
| G2 | gap between guide plate and take-up roll |
| M | contact position between take-up roll 7 and amorphous ribbon |
| R | amorphous ribbon engagement part |

The invention claimed is:

1. An amorphous ribbon switching system in a take-up device, said take-up device comprising two or more take-up rolls having magnetized surfaces for taking up a magnetic amorphous ribbon cast on a cooling roll, wherein at any given time a current take-up roll of said two or more take-up rolls is taking up amorphous ribbon and a next take-up roll of said two or more take-up rolls is not taking-up amorphous ribbons, said amorphous ribbon switching system comprising:

a cutting mechanism adapted to bring said next take-up roll into contact with the amorphous ribbon at a location between said current take-up roll and said cooling roll and then cut the amorphous ribbon; and a guide device comprising a guide roll and a guide plate disposed in proximity to the next take-up roll, wherein the guide roll is adapted to press a cut tip of the cut amorphous ribbon against the magnetized surface of said next take-up roll in a circumferential direction to prevent a folded back part of the cut tip from bulging out, and the guide plate is adapted to press the amorphous ribbon against the next take-up roll to guide the pressed amorphous ribbon to an engagement part of the amorphous ribbon.

2. The amorphous ribbon switching system as set forth in claim 1, wherein the cutting mechanism comprises:

a plurality of holding rolls adapted to press the amorphous ribbon and bring it into contact with the next take-up roll in an advancing direction of the amorphous ribbon; and a blade disposed between said plurality of holding rolls for cutting said amorphous ribbon.

* * * * *

UNITED STATES PATENT AND TRADEMARK OFFICE

CERTIFICATE OF CORRECTION

PATENT NO. : 8,235,091 B2
APPLICATION NO. : 12/311562
DATED : August 7, 2012
INVENTOR(S) : Shigekatsu Ozaki et al.

It is certified that error appears in the above-identified patent and that said Letters Patent is hereby corrected as shown below:

Title page under Item (22) PCT Filed:, change "May 10, 2007" to -- October 5, 2007 --;

Signed and Sealed this
Eighteenth Day of December, 2012

David J. Kappos

David J. Kappos
*Director of the United States Patent and Trademark Office*